US006088971A

United States Patent [19]

Nystrom

[11] Patent Number: 6,088,971

[45] Date of Patent: Jul. 18, 2000

[54] INTERLOCKINGLY ATTACHABLE ACCESSORIES FOR FRAME CONSTRUCTION BUILDINGS

[75] Inventor: Bruce C. Nystrom, Spencer, Iowa

[73] Assignee: Metal Works Inc., Spencer, Iowa

[21] Appl. No.: 09/165,330

[22] Filed: Oct. 1, 1998

Related U.S. Application Data

[63] Continuation-in-part of application No. 09/129,273, Aug. 5, 1998, Pat. No. 5,924,925.

[51] Int. Cl.[7] ..... E04D 13/158

[52] U.S. Cl. ..... 52/95; 52/96; 52/522; 52/539

[58] Field of Search ..... 52/95, 96, 217, 52/302.1, 522, 539

[56] References Cited

U.S. PATENT DOCUMENTS

| | | | |
|---|---|---|---|
| 3,969,866 | 7/1976 | Kyne | 52/522 X |
| 4,580,374 | 4/1986 | Quinnell | 52/95 |
| 5,243,793 | 9/1993 | MacLeod et al. | 52/95 |
| 5,729,933 | 3/1998 | Strength | 52/95 X |

OTHER PUBLICATIONS

Krause Publications, *Frame Building News*, Nov. 1998, pp. 8, 23, 30, 37,43 and 46, 47; Iola, Wisconsin 64990.

Modern Trade Communications, Inc., *Metal Construction News*, Oct. 1998, pp. 16, SG80 and 128, Skokie, Illinois 60077.

Cor–a–vent, *Strip Vent*, published prior to Oct. 1997, sales advertisement.

Niff–Corr Inc., Tippecanoe, IN, published prior to Oct. 1997, sales brochure.

Ridge Master, Plymoth, MI, 1996, sales brochure.

McElroy Metal, Inc., one page of brochure "What a Perfect Match," published in Shreveport, LA prior to Aug. 5, 1998.

Ridgolator, one page of brochure/catalog for roof vents and louvered soffits, published prior to Aug. 5, 1998.

*Primary Examiner*—Christopher T. Kent

*Attorney, Agent, or Firm*—Zarley, McKee, Thomte, Voorhees & Sease

[57] ABSTRACT

A soffit for a building having an exterior wall covered by siding and further having a fascia strip spaced outwardly from the wall includes an elongated soffit strip having a channel formed therein adapted to receive the siding, and a folded portion laterally spaced apart from the channel; the folded portion having a folded back portion extending toward the channel, a folded forward portion extending away from the channel, and a transition portion connecting the folded back portion and the folded forward portion so as to define an opening therebetween for receiving an adjacent member; and at least one interlocking member on the soffit strip for detachably mounting the soffit strip to the adjacent member without the use of tools.

18 Claims, 10 Drawing Sheets

INTERLOCKINGLY ATTACHABLE ACCESSORIES FOR FRAME CONSTRUCTION BUILDINGS

CROSS-REFERENCE TO RELATED APPLICATION(S)

This application is a continuation-in-part of U.S. application Ser. No. 09/129,273 entitled ROOF VENTILATING SYSTEM FOR FRAME CONSTRUCTION BUILDINGS filed on Aug. 5, 1998, now U.S. Pat. No. 5,924,925.

BACKGROUND OF THE INVENTION

The present invention relates to the field of accessories for buildings. More particularly, a first embodiment of this invention relates to a convection-type vent for a frame-style building having a peaked roof. This vent is especially well adapted to metal buildings which are often used for storage on farms and the like. The invention provides a vent cover that has an end flashing attachment which snaps into the end cap of the vent cover assembly without the use of tools and then can be installed over the vent opening as an integrated unit.

The second embodiment of this invention relates to a soffit system for metal buildings and the like. More particularly, this soffit system utilizes an interlocking structure similar to the one used in the vent cover embodiment. The interlocking structure allows the soffit to be installed between the siding and fascia of the building without extra trim pieces. Various widths of soffit strips and even extension pieces can be provided to fit a given soffit area width.

Vent Cover

Vents having powered fans are well-known for ventilating buildings. However, the power required to operate the fan in such devices is not always readily available. Furthermore, ventilating the building in this manner may be cost prohibitive because of the energy costs. Passive, convection-style vents provide a less expensive alternative to powered fans for ventilating buildings. Convection-style vents can be placed in a variety of locations on the building, including but not limited to the sides, ends, or roof. In buildings having peaked roofs, the natural flow of air within the building rises to the uppermost area, which is typically adjacent the peak of the roof. Therefore, it is well known to install one or more individual vents or a single continuous vent along the peak of a roof.

Despite the lack of moving parts and general simplicity of convection-style vents, they are often challenging to install over the vent opening. The vents need to be readily adaptable to roofs of different pitch. The installer must often hold the vent assembly together with one hand while drilling holes for fastening the end flashings to end caps on the vent cover with the other hand. This increases the risk of injury to the installer.

Therefore, there is a need for a vent having an easily mountable end flashing attachment. Thus, a primary objective of the present invention is the provision of a vent that has an end flashing attachment which is easily installable, preferably without the use of tools.

Another objective of the present invention is the provision of a vent having flashing strips and a vent cover which matingly interlock so as to detachably mount the vent cover to the flashing strips and cover the vent opening.

Another objective of the present invention is the provision of a vent wherein a pair of lances in the end of the vent cover and a corresponding pair of lances on the flashing strip engage each other so as to limit the movement of the vent cover relative to the flashing strip in an installed condition.

Another objective of the present invention is the provision of a vent for a roof wherein the vent can be adapted to mount to the peak of a roof having a pitch in a given range.

Another objective of the present invention is the provision of a vent which requires no separate fasteners to secure the vent cover to the flashing strips.

Another objective of the present invention is the provision of a vent which is economical to produce, durable and reliable in use, and relatively easy and safe to install.

Soffit

Existing soffit structures are difficult to assemble and require hand tools such as drills, screwdrivers, pliers, hammers and the like to install. Buildings also differ in the length and width of their soffit area. Therefore, there is a need for a more conveniently installable soffit.

Thus, another primary objective of the present invention is the provision of a soffit which is easily installable, preferably without the use of tools, where connected to the fascia.

Another objective of the present invention is the provision of a soffit having an integral channel for protecting the top edge of the metal siding when installed on the side of the building.

Another objective of the present invention is the provision of a soffit assembly wherein an interlocking member, such as a lance protruding adjacent a crease, in the soffit strip matingly interlocks with a similar structure on an adjacent soffit strip or a fascia strip to hold the soffit strip in place.

Another objective of the present invention is the provision of a soffit assembly which can come in various widths or be widened with extensions or adapters.

Another objective of the present invention is the provision of a soffit which requires no separate fasteners to be secured between the soffit and the fascia (or soffit extensions).

Another objective of the present invention is the provision of a soffit assembly which is economical to produce, durable and reliable in use, and relatively easy and safe to install.

Broadly stated, another objective of this invention is the provision of interlockingly attachable accessories for buildings.

These and other objectives will be apparent from the drawings, as well as from the description and the claims which follow.

SUMMARY OF THE INVENTION

The present invention relates to mounting accessories, such as soffits, vent covers, and the like, on buildings. This invention relates to a soffit that includes an elongated soffit strip having a channel formed therein adapted to receive the siding, and a folded portion laterally spaced apart from the channel; the folded portion having a folded back portion extending toward the channel, a folded forward portion extending away from the channel, and a transition portion connecting the folded back portion and the folded forward portion so as to define an opening therebetween for receiving an adjacent member; and at least one interlocking member on the soffit strip for detachably mounting the soffit strip to the adjacent member without the use of tools.

The soffit of this invention also facilitates a modular soffit assembly that allows various widths of soffit strip to be formed in order to cover the width of the gap between the siding and the fascia.

The soffit and an adjacent member, such as another soffit strip or a fascia piece can be provided with interlocking member thereon. The installer mounts the soffit strip on the building overhang utilizing prepunched holes and conventional fasteners such as nails. The integral channel receives the siding material and protects the top edge against damage or rusting. The siding is then fastened in place. The soffit extension or fascia then snaps into the interlocking member on the soffit.

DETAILED DESCRIPTION OF THE PREFERRED EMBODIMENTS

Vent Cover

Figure 1:
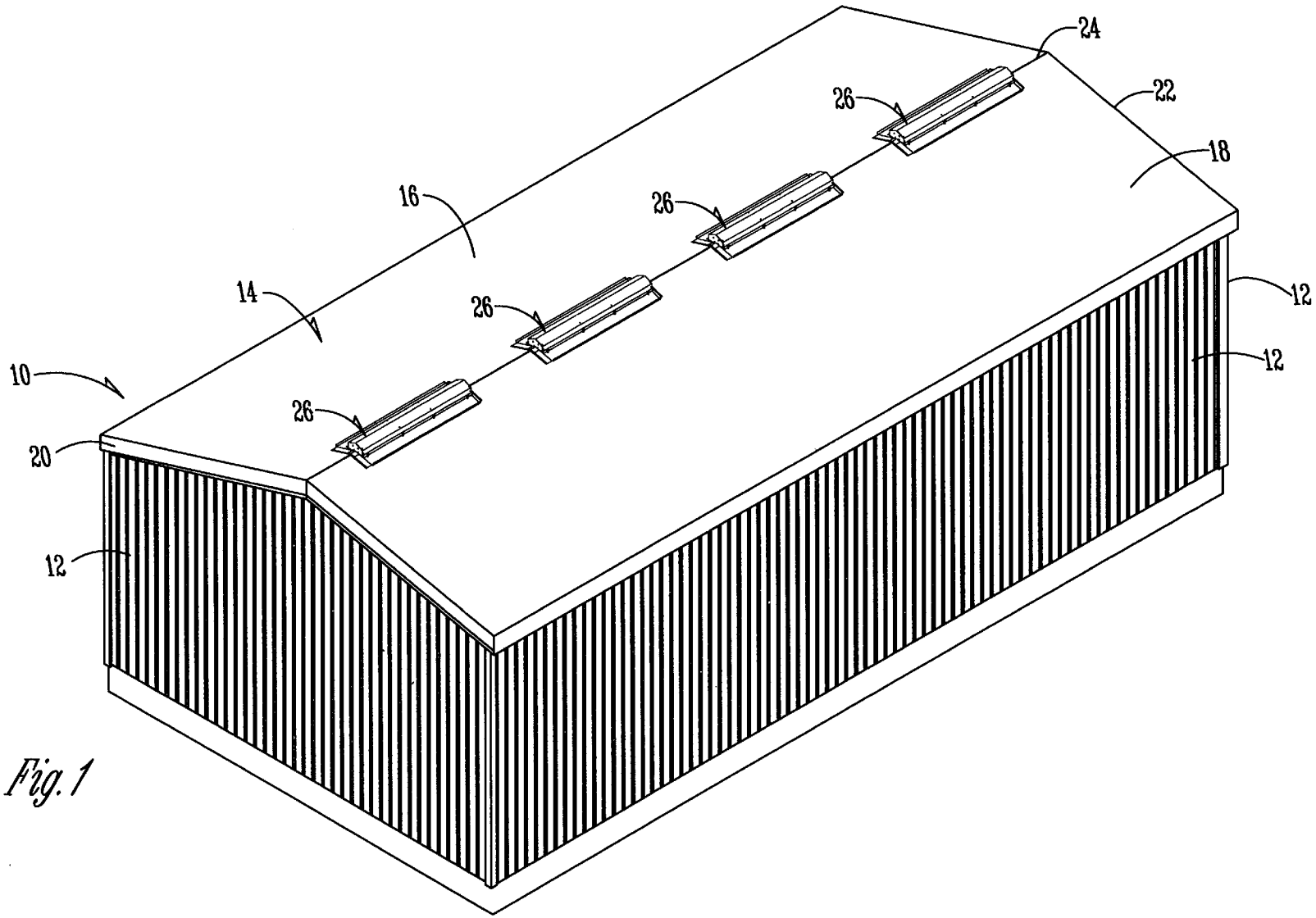
FIG. 1 is a perspective view of the vent of the present invention installed on a building having a peaked roof.

In FIG. 1, a conventional building 10 has a plurality of building sides 12 covered by a roof 14. The roof 14 has a plurality of roof sides 16, 18. The opposite ends of the roof sides 16, 18 form the ends 20, 22 of the roof. The roof sides 16, 18 are peaked with respect to horizontal and meet at a peak 24 or centrally located ridge.

A plurality of convection-type vents 26 are mounted along the peak 24 of the roof 14. The vents 26 can be spaced apart as shown or connected or formed as one continuous vent extending the length of the peak 24. The vents 26 cover a conventional vent opening 25 in the roof 14.

Figure 2:
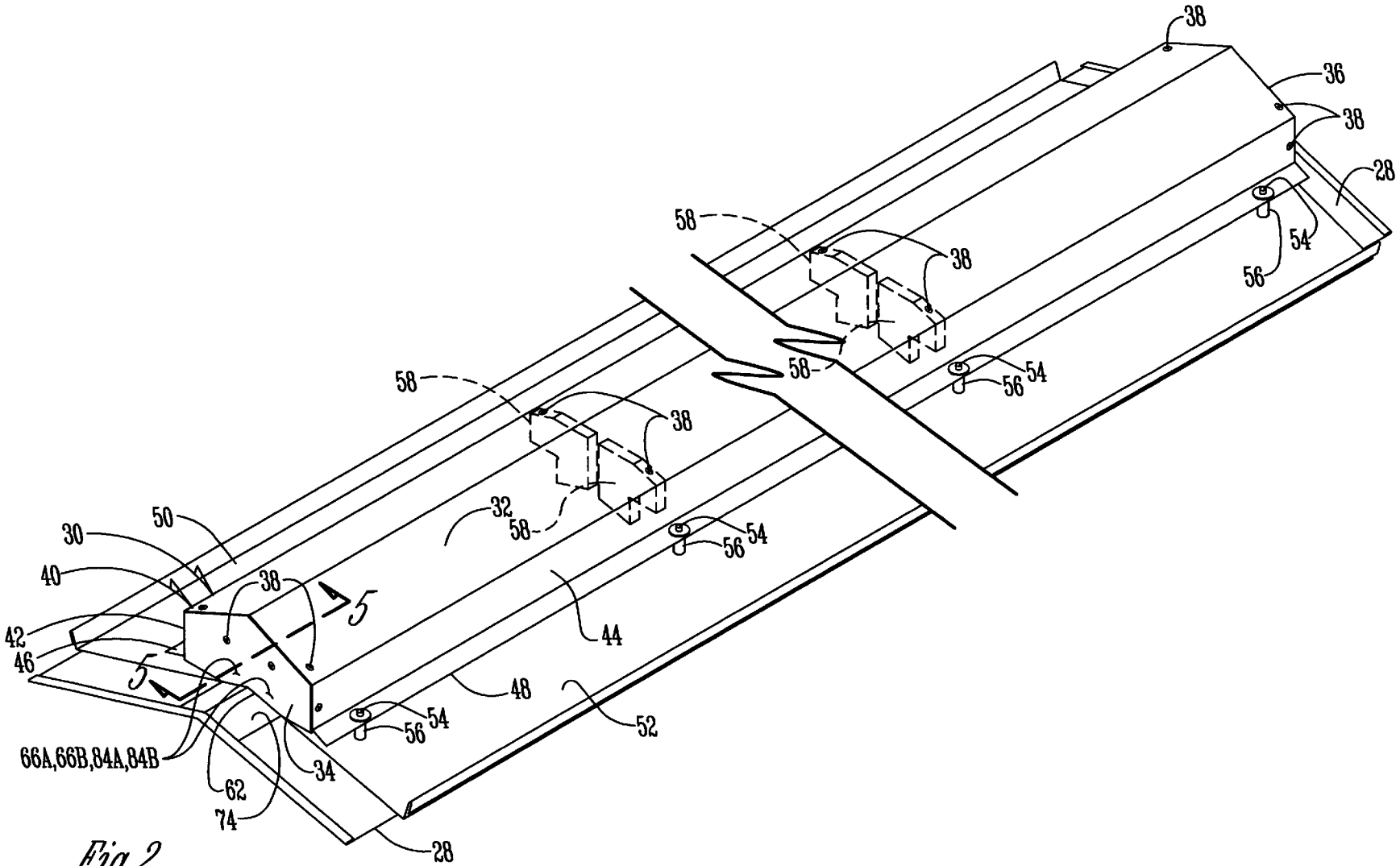
FIG. 2 is a perspective view of the vent of the present invention.

FIG. 2 shows the major components of the vent 26 of this invention. The vent 26 includes a pair of spaced apart flashing strips 28 which snappingly engage an elongated vent cover 30. The vent cover 30 is adapted to extend over the vent opening. The vent cover 30 includes a ventilator cap 32, which is generally elongated. The ventilator cap 32 has end caps 34, 36 which are preferably attached at the factory by conventional fasteners, including but not limited to rivets 38. The ventilator cap 32 also has a raised portion 40 and sides 42, 44 connected thereto.

Figure 5:
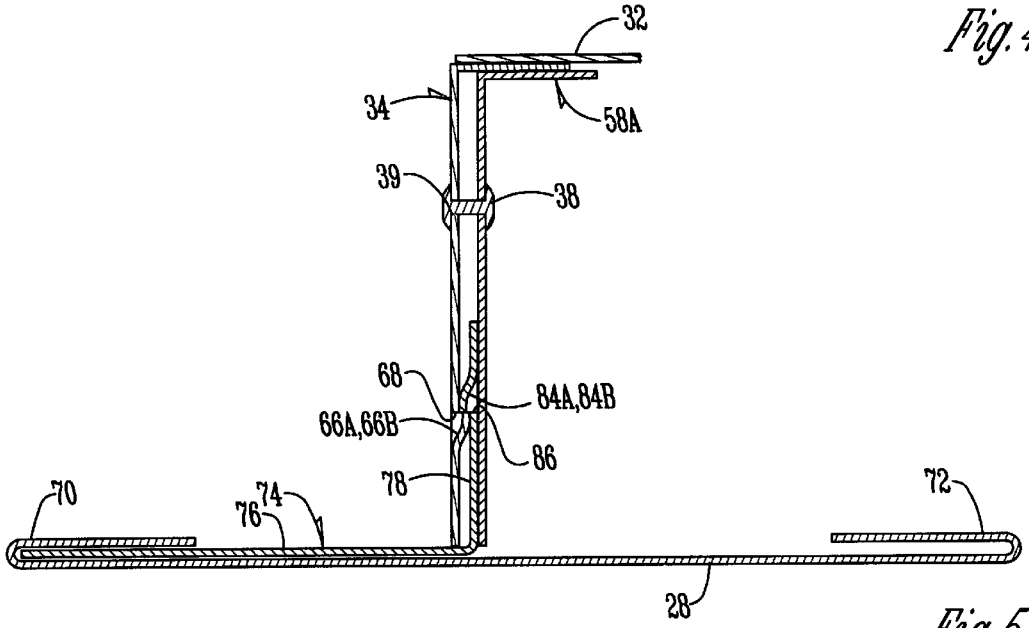
FIG. 5 is a cross-sectional view taken along line 5—5 in FIG. 2 and shows how the riser of the flashing strip engages the end cap of the vent cover.

Each of the sides 42, 44 has a flange 46, 48 extending outwardly therefrom in a substantially horizontal direction. The flanges 46, 48 extend longitudinally along the ventilator cap 32 and provide a means for mounting a pair of skirts 50, 52 in spaced relation to the ventilator cap 32. A plurality of longitudinally spaced fasteners 54 attach the skirts 50, 52 to the respective flanges 46, 48. A preferably hollow tubular spacer 56 is interposed between the flanges 46, 48 and the respective skirts 50, 52 to provide the proper spacing for the ventilation desired. Reinforcing strips 58 and 58A are provided along the length of the ventilator cap 32 and provide additional strength and rigidity, as shown in FIGS. 2 and 5. The assembled vent cover 30 and the detached flashing strips 28 can be sold to the consumer as a complete kit, ready for installation.

Figure 4A:
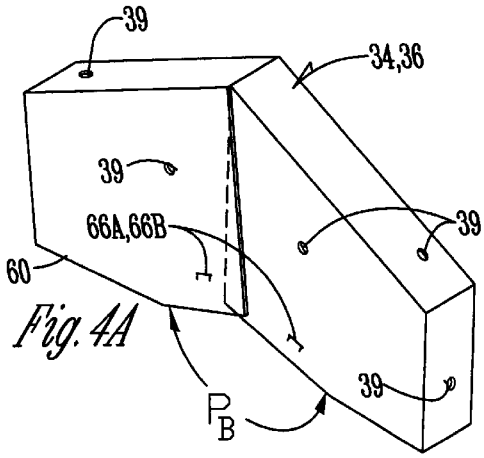
FIG. 4A is similar to FIG. 4, but shows the end cap cut and bent to vary its pitch.
Figure 4:
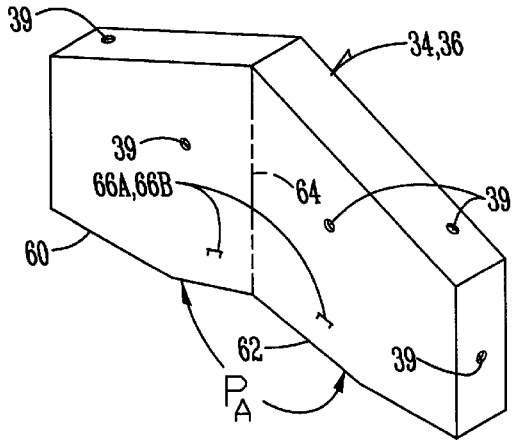
FIG. 4 is a perspective view of the end cap of the present invention.

Referring to FIGS. 2 and 4, the end caps 34, 36 are essentially identical and mount at either end of the ventilator cap 32. As best seen in FIG. 4, a plurality of holes 39 extend through the end cap 34, 36 and receive the fasteners 38. Each of the end caps 34, 36 has a profile in a vertical plane that is adapted to mate with the ventilator cap 32 and substantially match the peak 24 of the roof 14. The lower edge 60 of the end caps 34, 36 includes a centrally located pitch notch 62 which allows the end caps 34, 36 to conform to the peak 24 of the roof 14 within a given range of pitch. Preferably the notch 62 has a pitch or rise over run of between 4/12 and 6/12. FIG. 4 shows that the end caps 34, 36 can have a cut line 64 marked thereon extending from the apex of the pitch notch 62 to the apex of the end cap 34, 36. As shown in FIG. 4A, the end cap 34, 36 can be cut with tin snips along the cut line 64. This allows the end cap to be bent to a smaller angle at its apex. The cut portions of the end cap 34, 36 overlap each other at the cut line 64. The pitch notch 62 which results in FIG. 4A has a greater pitch $P_B$ than the pitch $P_A$ shown in FIG. 4. Another way of looking at this is that the angle at the apex of the notch 62 in FIG. 4 is greater than the angle at the apex of the notch in FIG. 4A.

The end caps 34, 36 include at least one lance, preferably a pair of lances 66A, 66B, which are formed on the outer face of the end cap 34, 36. The lances 66A, 66B are preferably spaced apart laterally on opposite sides of the cut line 64. As best seen in FIG. 5, the lances 66A, 66B on the end cap 34, 36 are punched or formed in the lightweight sheet metal material of the end cap 34, 36. The lances 66A, 66B extend inwardly from the outer face of the end caps 34, 36 along a generally horizontal slit 68.

Figure 3:
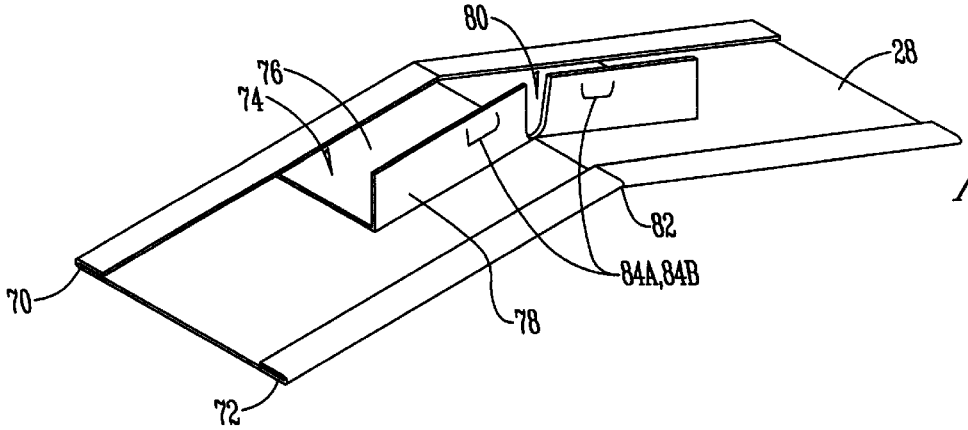
FIG.3 is a perspective view of the flashing strip of this invention, including the riser.

Referring to FIGS. 3 and 5, the flashing strips 28 are formed of a weather resistant flexible lightweight material, such as sheet metal. The flashing strip 28 preferably includes a folded hem 70, 72 extending longitudinally on either side. The hems 70, 72 add strength and rigidity to the edges of the flashing strip 28 so that conventional fasteners, including but not limited to screws, nails, and the like, may be inserted therethrough to attach the flashing strip 28 (and thereby the vent cover 30) to the roof 14. The folded hem 70 also serves as a means of locating and securing a riser 74 to the flashing strip 28. The riser 74 includes a base 76 having an upright 78 attached thereto. The base rests on the flashing strip 28 and extends under the folded hem 70. Conventional fastening means, such as rivets or spot welds, can also be used to rigidly secure the riser 74 to the flashing strip 28. The upright 78 has a centrally located U-shaped or V-shaped notch 80 therein. The notch 80 extends substantially to the base 76 of the riser 74. The riser 74 is positioned centrally along a longitudinal axis of the flashing strip 28. Due to the notch 80, the flashing strip 28 and the riser 74 attached thereto are capable of bending about a seam or crease 82 so as to juxtaposition or adapt closely to the pitch of the roof 14. Thus, the flashing strip 28 installs flat on the roof sides 16, 18 and extends transversely across the peak 24 of the roof 14.

The flashing strip 28 also includes thereon at least one lance, and preferably a pair of lances 84A, 84B. The lances 84A, 84B are formed or punched in the upright 78 of the riser 74 as shown in FIG. 3, but other locations on the flashing strips 28 are possible without detracting from the invention. The lances 84A, 84B are preferably placed on opposite sides of the notch 80 or the seam 82. As best seen in FIG. 5, the lances 84A, 84B are punched inwardly through the upright 78 toward the base 76 from a substantially horizontal slit 86.

The lances 66A, 66B of the end caps 34, 36 and the lances 84A, 84B of the flashing strips 28 matingly interlock so as to detachably mount the flashing strips 28 to the vent cover 30. The lances 66A, 66B, 84A, 84B slide over each other vertically until they engage and eventually fully interlock as shown in FIG. 5. In the position shown, the end caps 34, 36 and the vent cover 30 attached thereto cannot be easily moved relative to each other. In fact, the vent cover 30 is secured to the flashing strips 28 and resists movement in both vertical and horizontal directions.

In use, the integrated vent cover assembly of the present invention is secured across the peak 24 of the roof 14 by the flashing strips 28 and conventional fasteners (not shown) at appropriately spaced intervals along the peak 24. Generally these intervals will correspond to the length of the vent cover 30 selected. This is relatively easy to do because the flashing strips 28 are snappingly preattached to the vent cover 30. Unlike the devices currently available, this preattachment step can be accomplished snappingly without the use of power or hand tools. Conventional vents typically have to be drilled and screwed together just prior to their final placement in the desired location on the roof. The required drilling operation has proven to be slow, cumbersome, and even potentially dangerous when tried on the roof. In this invention the necessary locational relationships are provided at the factory. The vent cover 30 attaches to the flashing strips 28 without drilling, fasteners, or tools. If required, the vent cover 30 can be removed from the flashing strips 28 by using a screw driver to gently pry the lances 66A, 66B, 84A, 84B apart while simultaneously pulling the vent cover 30 away from the flashing strip 28.

Figure 6:
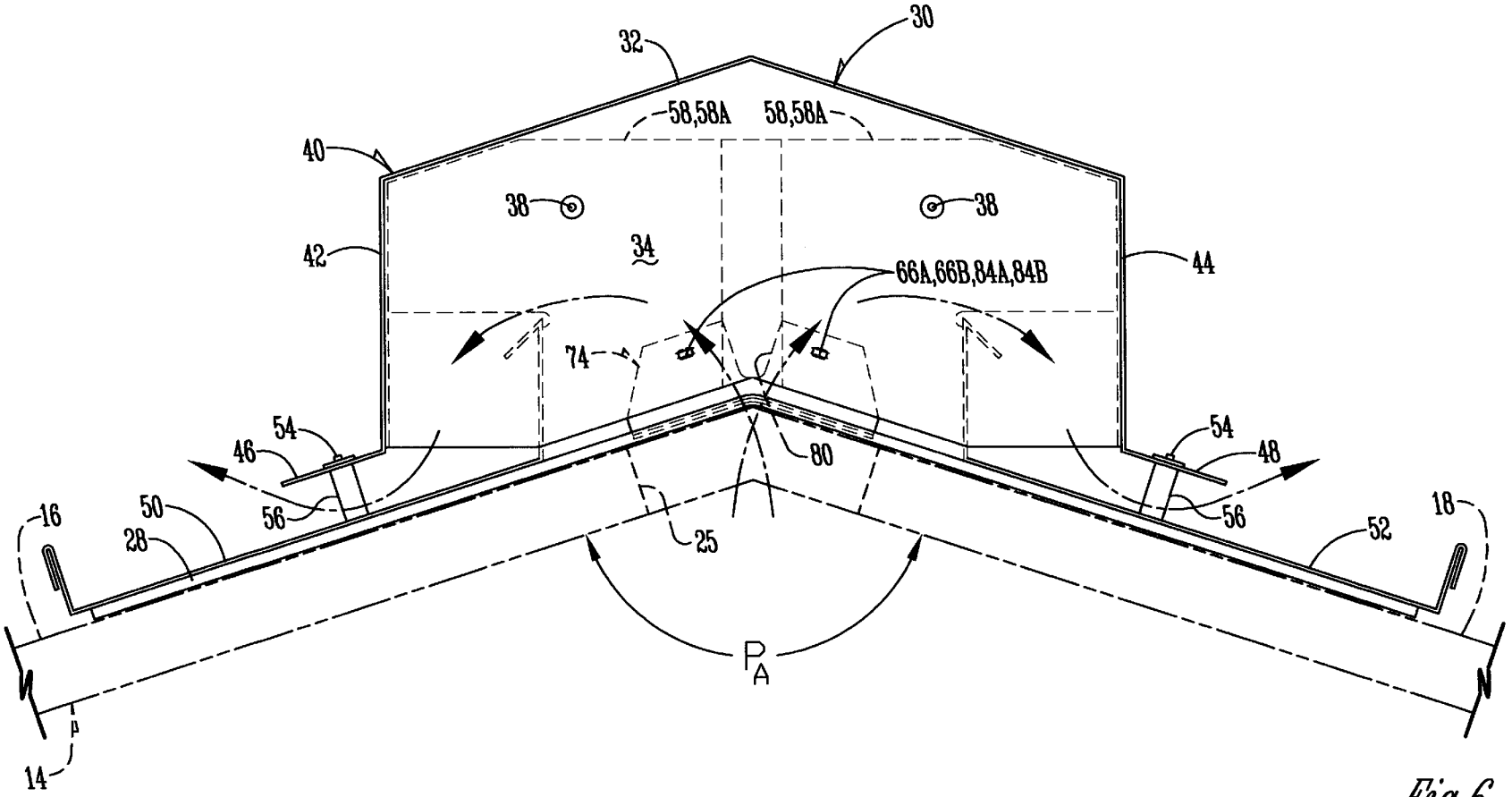
FIG. 6 is an end view of the vent of this invention mounted on a peaked roof having a first given pitch.
Figure 7:
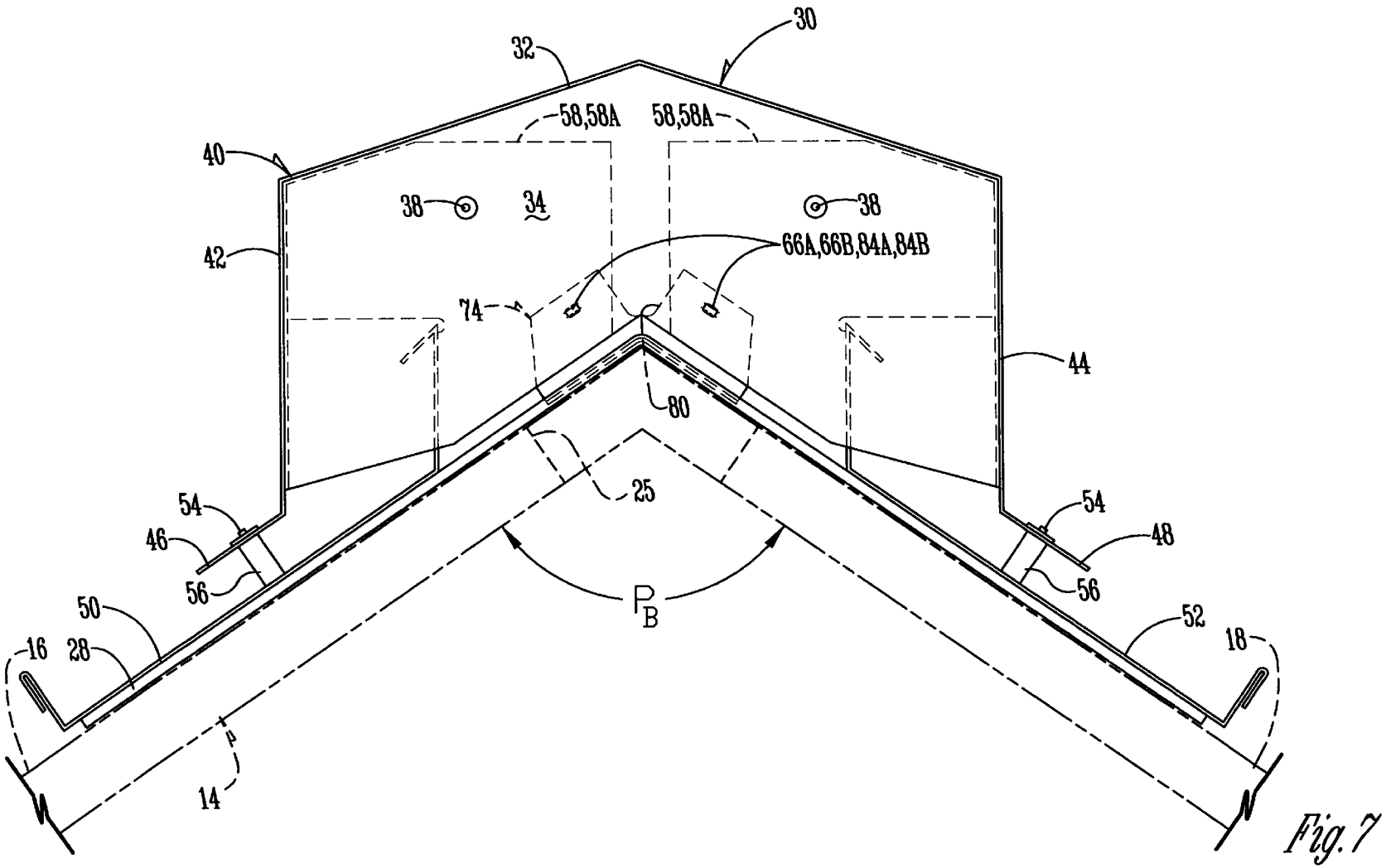
FIG. 7 is an end view similar to FIG. 6, except the cover is mounted on a peaked roof having a second, steeper given pitch.

The device of this invention is extremely flexible. The flashing strips 28 bend to conform to a roof having almost any pitch. The end cap 34, 36 of the vent cover 30 is formed so that it will substantially conform to any roof having a pitch in the range of 4/12 to 6/12. Furthermore, the end cap 34, 36 can be cut as shown in FIG. 4A to conform to pitches from 9/12 to 12/12. FIG. 6 shows the vent 26 of this invention mounted on a roof having a pitch of approximately 4/12. FIG. 7 illustrates how the present invention can be easily adapted to a roof having a pitch of approximately 12/12. The notch 80 can be specifically formed for such a pitch, or the cut line 64 can be utilized and the vent cover 30 bent about the line 64 to provide a steeper pitch.

The vent 26 of the present invention is preferably made of sheet metal or other lightweight, durable and formable material. Of course, the components, including the spacers 56, can be dimensioned so as to provide the desired ventilation space or gap between the ventilator cap 32 and the skirts 50, 52.

Soffit

Figure 8:
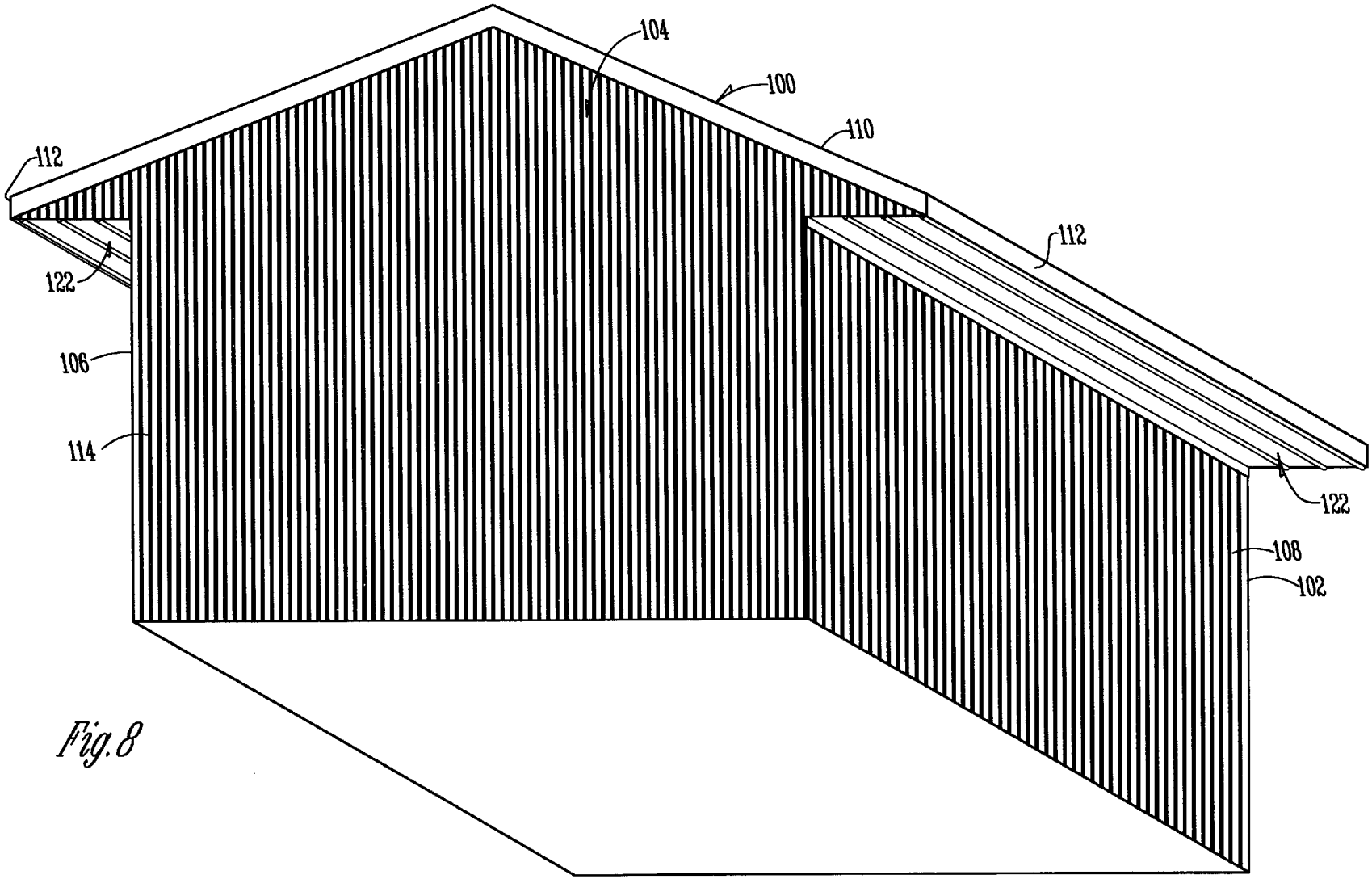
FIG. 8 is a perspective view of a building equipped with a second embodiment of this invention involving a soffit.
Figure 13:
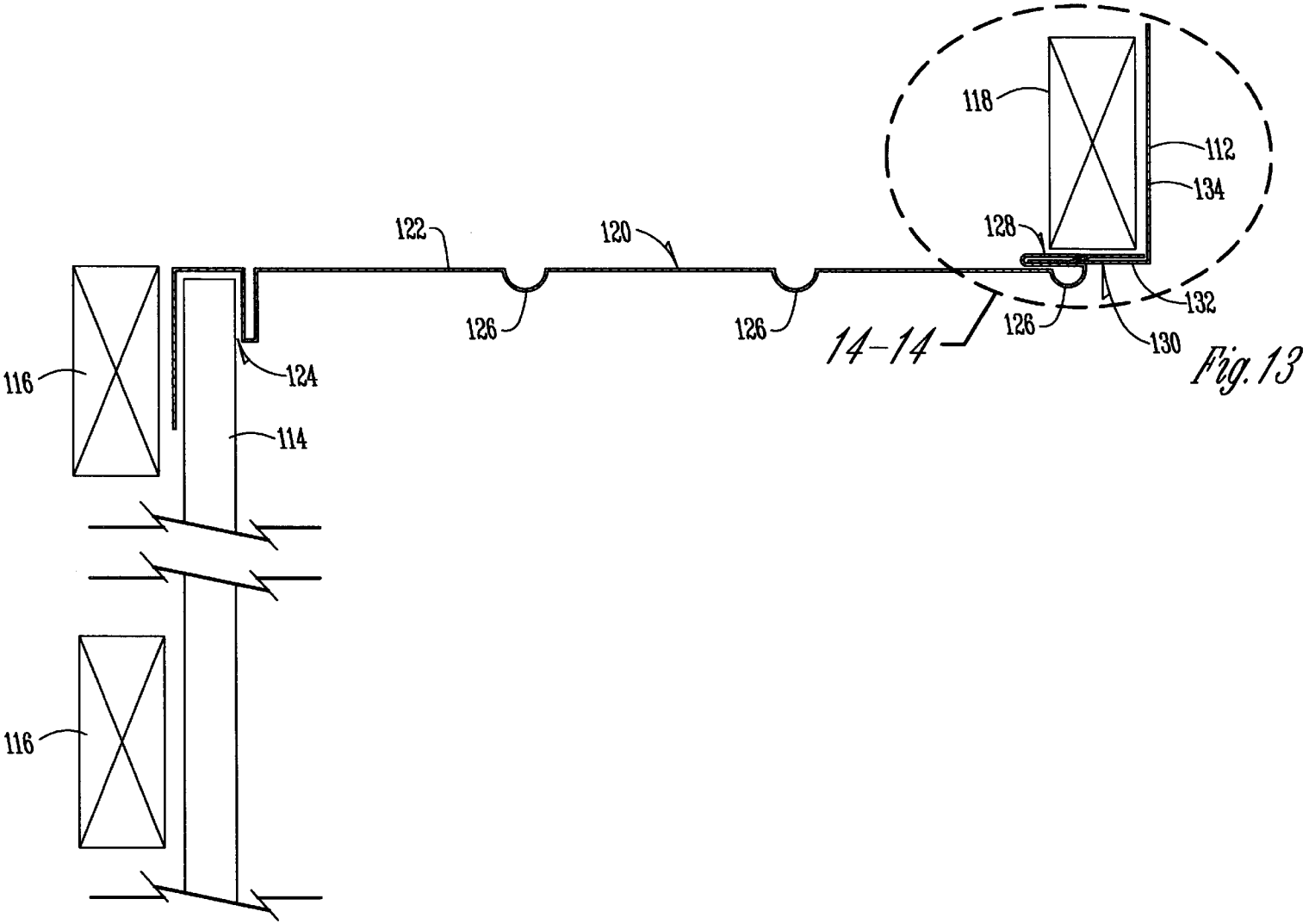
FIG. 13 is a cross-sectional view similar to FIG. 9, but shows the soffit strip attached to the siding and fascia.

A building 100 is illustrated in FIG. 8. The building 100 has opposite ends 102, 104 and sides 106, 108. The building 100 also includes a roof 110 which has fascia 112 along at least some of its edges. As is conventional, siding 114 is applied to the support members 116 (FIG. 13). FIG. 13 shows that the fascia 112 is attached to a support rail 118 which extends longitudinally along the lower portion of the roof line. Referring again to FIG. 8, a soffit 120 or soffit assembly mounts between the fascia 112 and the siding 114.

Figure 9:
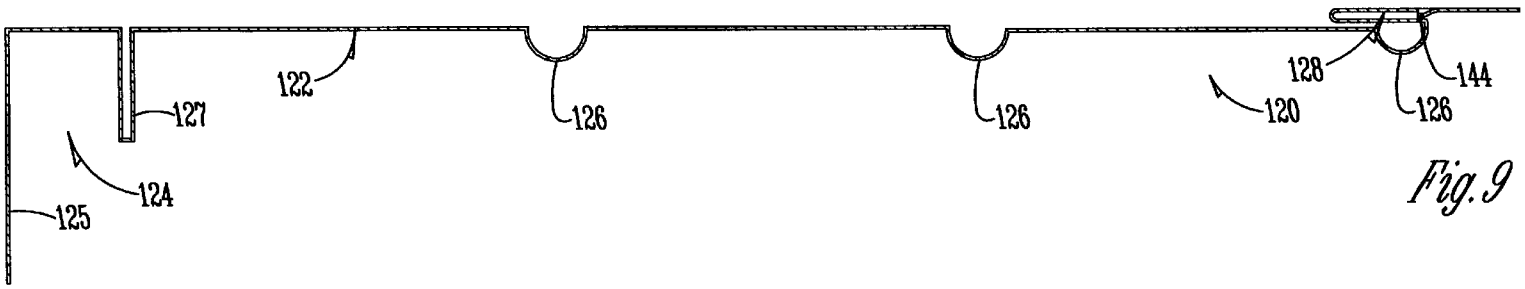
FIG. 9 cross-sectional view of the soffit area taken along 9—9 in FIG. 8.

The soffit 120 is shown in greater detail in FIG. 9. The soffit 120 includes a soffit strip 122 which is elongated in the same direction as the fascia 112. A channel 124 is formed in the soffit strip 122. Preferably the channel 124 is J-shaped and is adapted to receive the upper end of the siding 114. The J-shaped channel comprises a long leg 125 and a short leg 127 spaced apart horizontally therefrom. The short leg 127 can be formed by a pair of interconnected vertical walls slightly spaced as shown. This also facilitates the use of conventional sheet metal forming operations to form the soffit strip 122.

One or more ribs 126 extend longitudinally along the soffit strip 122. Preferably, the ribs 126 protrude downwardly as shown. The ribs 126 make the soffit strip 122 appear to be comprised of a plurality of wooden boards and provide additional structural rigidity.

Figure 14:
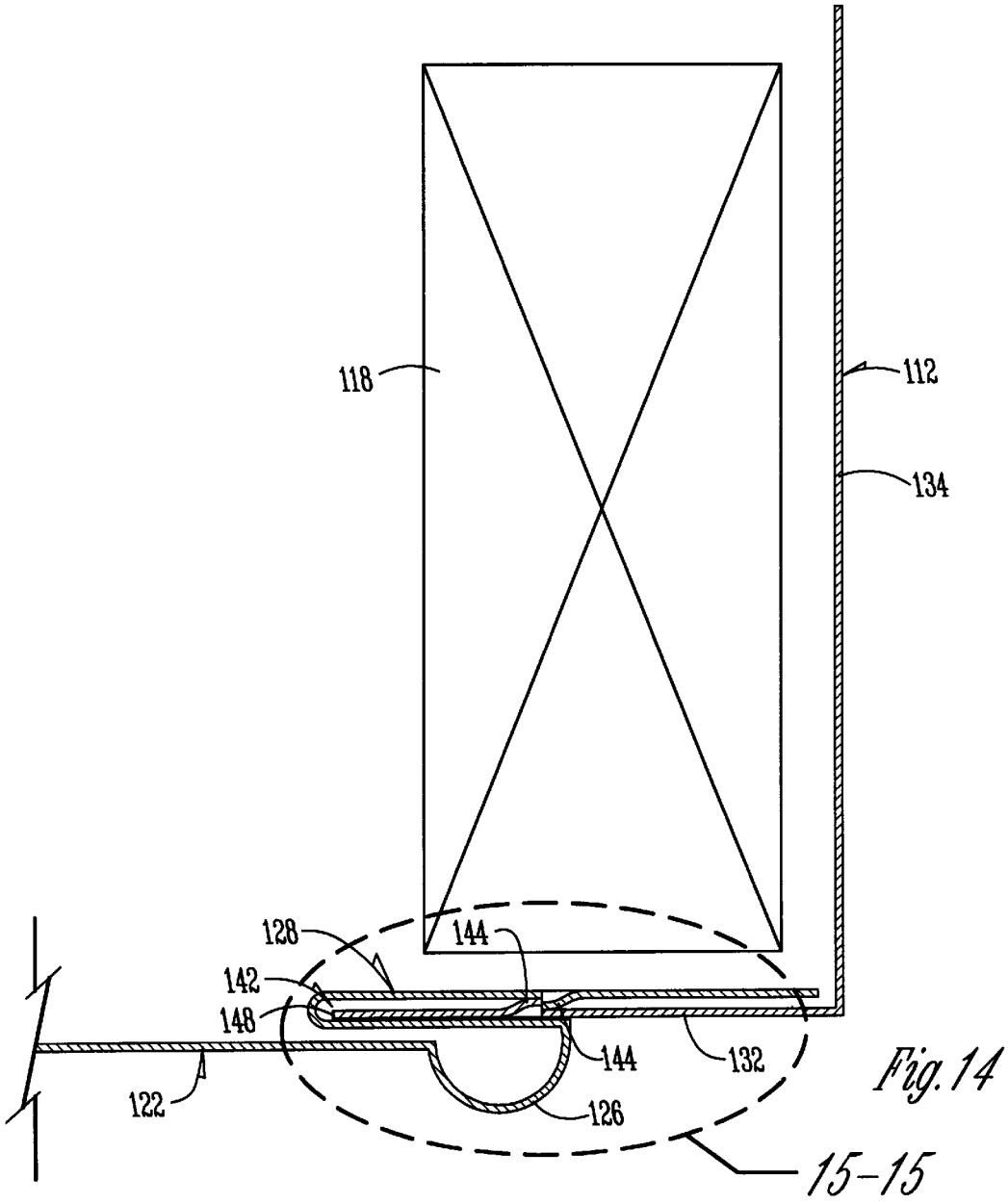
FIG. 14 is an enlarged cross-sectional view taken of the area 14—14 in FIG. 13. This figure shows the interlocking connection between the soffit and the fascia.
Figure 15:
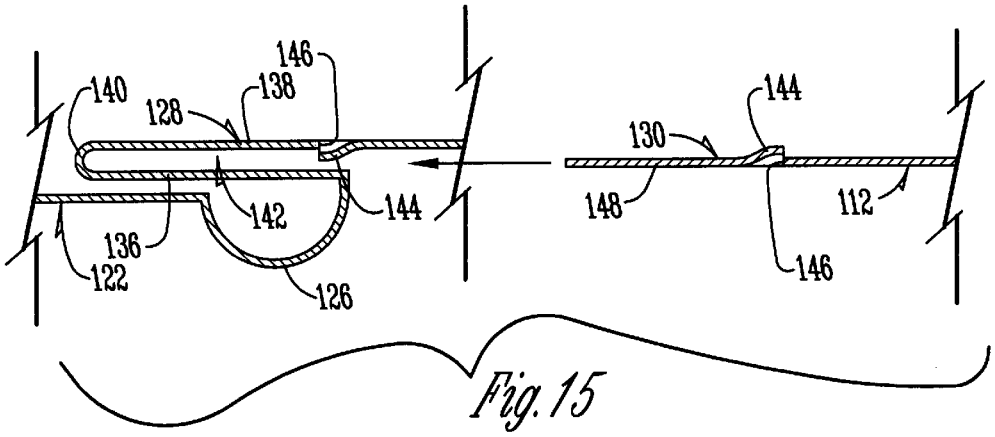
FIG. 15 is an exploded assembly view, in cross-section, which shows the interlocking members of this invention.

At least one interlocking member 128 is on the soffit strip 122, preferably near its outer edge. As best seen in FIGS. 13–15, the interlocking means 128 on the soffit strip 122 snappingly engages a similar interlocking means 130 on the fascia 112. Preferably the interlocking means 130 is located on a generally horizontal leg 132 of the fascia 112. The fascia 112 also includes a generally vertical leg 134 which is connected to the generally horizontal leg 132.

The interlocking means 128 includes a folded portion comprising a folded back portion 136 which extends toward the channel 124 or the siding 114, a folded forward portion 138 which extends toward the fascia 112, and a transition portion 140 which connects the folded back portion 136 and the folded forward portion 138. The transition portion 140 is preferably U-shaped in cross section, but a variety of other closed-ended shapes can be used without detracting from the present invention. Thus, an opening 142 extending in a generally horizontal direction is formed between the folded back portion 136 and the folded forward portion 138.

The interlocking function is provided by a lance 144 protruding into the mouth of the opening 142 adjacent a crease or slit 146 formed in the soffit strip 122. The protruding lance 144 has a ramp side which rises to join a substantially vertical side having a base and a peak. The slit 146 is formed adjacent the base of the vertical side. A slit 146 is preferred because it helps limit movement in more directions. The crease 146 preferably extends completely through the material to form a slit, but a mere fold or bend in the material may be sufficient so long as an adequately sloped and abrupt protrusion 144 is formed. One skilled in the art will appreciate that the lance 144 and crease 146 can be formed in either of the folded portions 136, 138.

Similar interlocking means 130 are located on the fascia 112 rearward of a tongue member 148. As best understood in view of FIGS. 14 and 15, the lance 144 on the fascia 112 protrudes in an opposite direction from the lance 144 on the soffit strip 122. Thus, when the tongue 148 of the fascia 112 is inserted into the opening 142 on the soffit strip 122, the lances 144 slide over each other and gently spread the folded portions 136, 138 apart until the lance 144 on the fascia 112 clears the lance 144 on the soffit strip 122. At that time, the folded portions 136, 138 spring back inwardly and snappingly interlock the soffit strip 122 and the fascia 112. The interlocking means 128, 130 resist forces tending to pull them apart especially in the lateral direction. This happens in substantially the same manner as with the matingly interlocking components of the vents described earlier. No tools are required to attach the soffit strip 122 to the fascia 112. However, if desired, the soffit strip 122 can be detached from the fascia 112 by prying the portions 136, 138 apart with a screwdriver or the like and sliding the tongue 148 of the fascia 112 out of the opening 142 in the soffit 122. FIG. 14 shows the means 128, 132 in an interlocked condition. Of course, a plurality of interlocking members, preferably longitudinally spaced and aligned in a row on the soffit strip, would securely interlock the components together.

Figure 16:
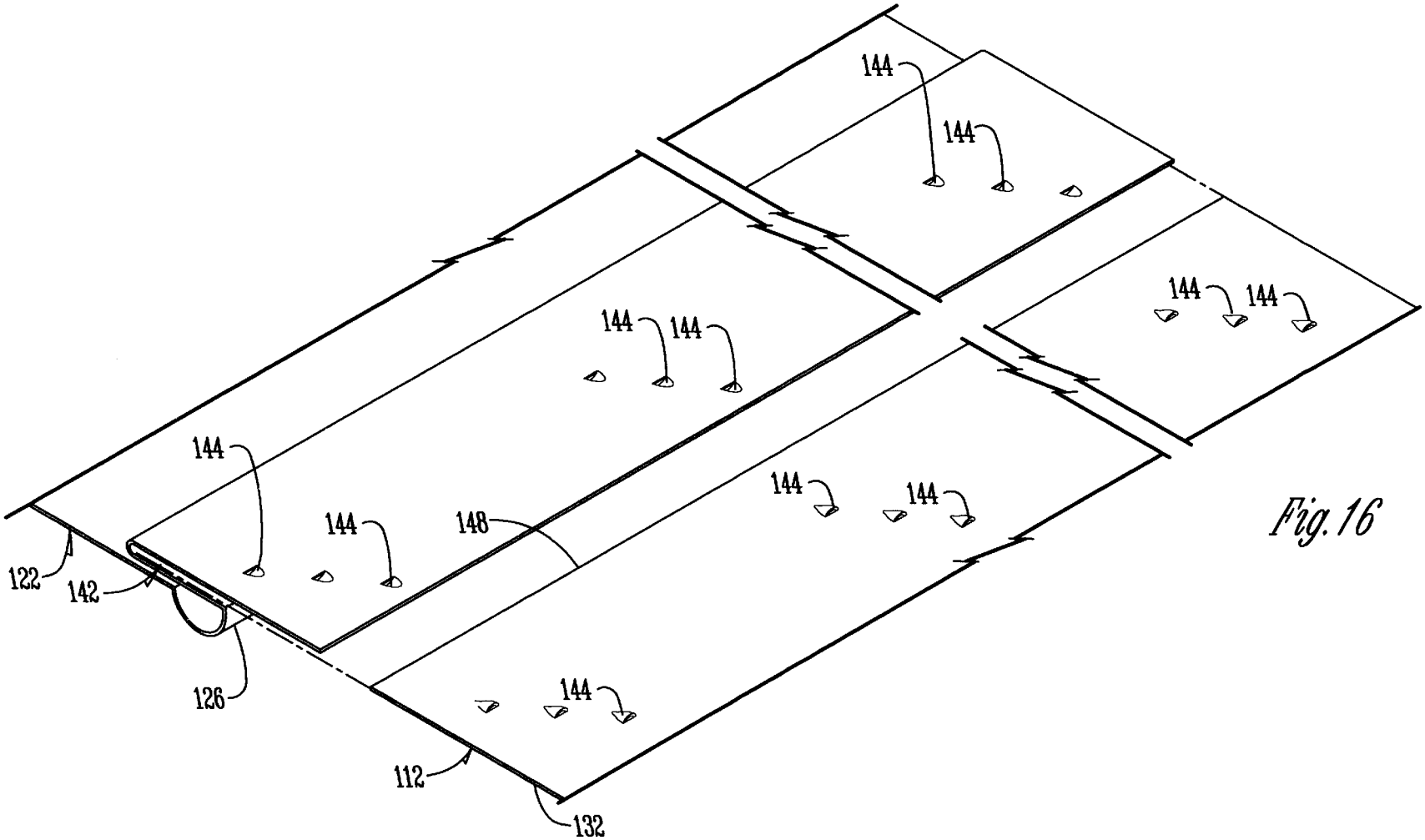
FIG. 16 is a perspective view of the soffit edge with a series of lances formed therein to allow more or less of the fascia to be inserted into the soffit, thus allowing for variation in building overhang widths.

As best seen in FIG. 16, longitudinally spaced and laterally staggered multiple (or a series of) lances 144 may be formed on the soffit strip 122 to allow for building variations. This allows the installer to snap the fascia 112 in as far as necessary to give a straight ("clean") building line on the outside edge. The lances 144 are spaced along the length of the soffit strip 122. Of course, similar series of lances can also be used on the fascia and/or the soffit extensions of the modular soffit assembly described below.

Figure 10:
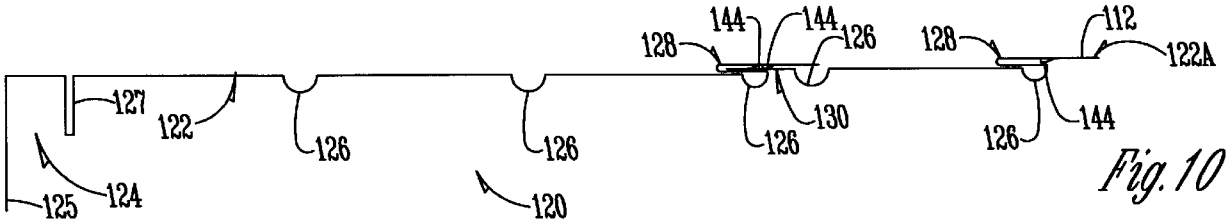
FIG. 10 is a simplified cross-sectional view similar to FIG. 9, but shows an adjacent soffit strip. interlockingly interposed between the first soffit strip and the fascia. The figure is simplified in that the thickness of the pieces is ignored for clarity of illustration.
Figure 11:
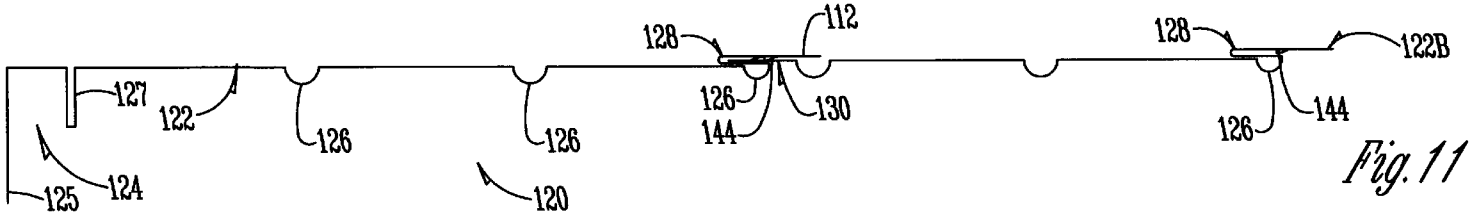
FIG. 11 is a simplified cross-sectional view similar to FIG. 10, but shows a wider second soffit strip being used.
Figure 12:
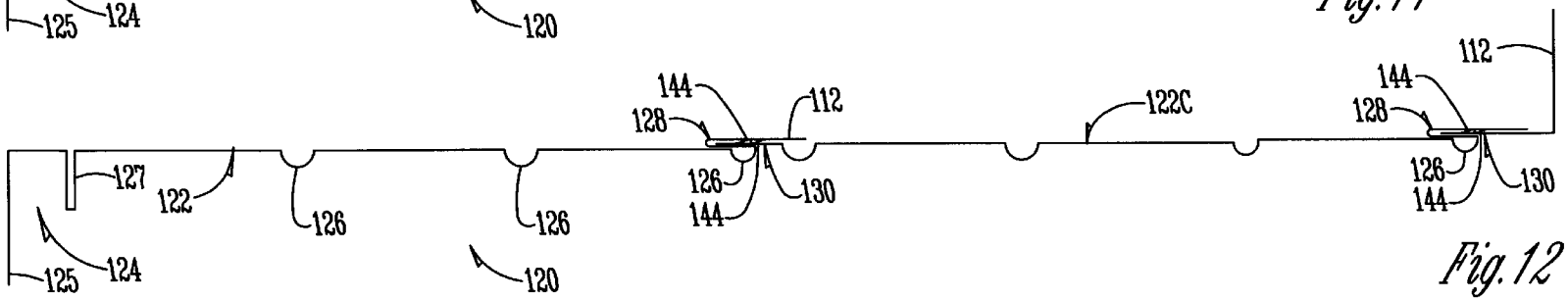
FIG. 12 is a simplified cross-sectional view similar to FIG. 10, but shows a still larger second soffit member being used adjacent the fascia.

FIGS. 10–12 illustrate how the present invention can be utilized to form a modular soffit assembly wherein the lateral width can be selectively construed. FIG. 10 shows the standard width soffit strip 122 being extended laterally by another adjacent member, extension strip, or soffit strip 122A. One edge of the soffit strip 122A has an interlocking means 130 like previously described on the fascia 112. An interlocking means 128 like on the standard soffit strip 122 is disposed on the other edge of the soffit strip 122A, laterally spaced from the interlocking means 130. Thus, the soffit strip 122A extends the soffit strip laterally and provides the same possible connection with another soffit strip or the fascia 112. FIGS. 11 and 12 illustrate how other soffit strips 122B, 122C can be selected so as provide the desired total width of the soffit or soffit assembly 120. For instance, a standard soffit having a nominal width of 12 inches can be extended to a 16 inch, 18 inch, or 24 inch width by snapping in the appropriate second piece. The fascia could then snap onto the terminal piece. This provides an efficient system whereby the manufacturer only has to produce a limited number of parts, and yet the consumer or end user has a great deal of flexibility in achieving a desired soffit assembly width.

This invention provides a method of detachably mounting the soffit assembly to siding and fascia on a building. The steps include providing a soffit strip with an interlocking member thereon, providing an interlocking member on the fascia, mounting the soffit strip to the siding, attaching the soffit strip to the fascia by engaging the interlocking member on the soffit with the interlocking member on the fascia.

From the above discussion, it should be apparent that many different accessories could be interlockingly attached to a building by using the basic interlocking structure of this invention. The accessory has a body portion and a first interlocking member 128 formed thereon for matingly slidingly interlocking with a complementary second interlocking member 130 on an adjacent member which is attachable to the building. The interlocking members 128, 130 each have a protruding portion 144 thereon which abuts and/or interlocks with the protruding member 144 on the other member 128, 130 so as to limit relative movement in at least one direction.

Thus, the present invention at least accomplishes its stated objectives.

In the drawings and specification, there has been set forth preferred embodiments of the invention, and although specific terms are employed, these are used in a generic and descriptive sense only and not for purposes of limitation. Changes in the form and the proportion of parts as well as in the substitution of equivalents are contemplated as circumstances may suggest or render expedient without departing from the spirit or scope of the invention as further defined in the following claims.

What is claimed is:

1. A soffit for a building having an exterior wall and an adjacent member spaced outwardly from the wall, comprising:

an elongated soffit strip including a first elongated terminal side edge and at least one interlocking member adjacent the side edge for slidingly interlockingly attaching the soffit strip to the adjacent member without the use of tools;

the interlocking member including a folded portion adjacent the side edge, the folded portion including a folded back portion beginning at the side edge and extending away from the side edge, a folded forward portion extending toward the side edge, and a transitional crease portion remote from the side edge and connecting the folded back portion and the folded forward portion so as to define a groove that is directed toward and opens along the side edge;

a plurality of spaced engagement members integrally formed on the folded back portion for retentively engaging corresponding mating engagement members on the adjacent member.

2. The soffit of claim 1 wherein the opening in the folded portion of the soffit strip extends horizontally.

3. The soffit of claim 1 wherein the engagement members each comprise a lance protruding from the soffit strip adjacent a crease formed in the soffit strip.

4. The soffit of claim 3 wherein a slit for delimiting the lance is formed in the crease.

5. The soffit of claim 1 wherein the transitional crease portion of the folded portion is U-shaped.

6. The soffit of claim 1 wherein the soffit has a plurality of outwardly protruding ribs extending longitudinally thereon, one of the ribs being connected to and generally extending underneath a substantial portion of the folded forward portion.

7. The soffit of claim 1 wherein the soffit strip has a J-shaped channel thereon laterally spaced from the interlocking member for receiving a substantially vertical siding member.

8. The soffit of claim 1 wherein the engagement members comprise a plurality of longitudinally spaced engagement members.

9. The soffit of claim 1 wherein the engagement members are aligned in a row.

10. The soffit of claim 3 wherein the engagement members comprise a plurality of lances arranged in a generally longitudinal direction along the soffit strip.

11. The soffit of claim 10 wherein the plurality of lances includes a series of lances comprising individual lances that are laterally staggered from each other.

12. The soffit of claim 11 wherein the series of lances is repeated approximately every twelve inches along the soffit strip.

13. The soffit of claim 1 wherein the folded back portion has upper and lower surfaces and the plurality of engagement members formed on the folded back portion protrude upwardly from the lower surface into the opening and toward the folded forward portion.

14. The soffit of claim 1 wherein the folded forward portion is longer than the folded back portion in a direction perpendicular to the side edge.

15. The soffit of claim 1 wherein the soffit strip has a thickness and the transitional crease portion has an inside radius that is approximately the same as the thickness of the strip.

16. The soffit of claim 1 wherein the engagement members on the folded back portion are protrusions that have a ramped surface which extends horizontally and vertically outward from the folded back portion to join a substantially vertical surface having a base and a peak, a slit being formed in the folded back portion adjacent the base.

17. A soffit for a building having an exterior wall and an adjacent member spaced outwardly from the wall comprising:

an elongated soffit strip including a first elongated terminal side edge, at least one outwardly protruding rib extending longitudinally on the soffit and at least one interlocking member adjacent the side edge for slidingly interlocking attaching the soffit strip to the adjacent member without the use of tools;

the interlocking member including a folded portion adjacent the side edge, the folded portion including a folded back portion beginning at the side edge and extending away from the side edge, a folded forward portion extending toward the side edge, and a transitional crease portion remote from the side edge and connecting to the folded back portion and the folded forward portion so as to define a groove that is directed toward and opens along the side edge, wherein at least one rib is connected to the interlocking member and extends underneath a substantial portion of the folded forward portion of the interlocking member; and a plurality of spaced engagement members integrally formed on the interlocking member for retentively engaging corresponding mating engagement members on the adjacent member.

18. A soffit for a building having an exterior wall and an adjacent member spaced outwardly from the wall, comprising:

an elongated soffit strip including a first elongated terminal side edge, at least one interlocking member adjacent the side edge for slidingly interlockingly attaching the soffit strip to the adjacent member without the use of tools and a J-shaped channel thereon laterally spaced from the interlocking member for receiving a substantially vertical siding member; and the interlocking member including the folded portion adjacent the side edge, the folded portion including the folded back portion beginning at the side edge and extending away from the side edge, a folded forward portion extending toward the side edge, and a transitional crease portion remote from the side edge and connecting the folded back portion and the folded forward portion so as to define a groove that is directed toward and opens along the side edge; and a plurality of spaced engagement members integrally formed on the interlocking member for retentively engaging corresponding mating engagement members on the adjacent member.

* * * * *